United States Patent [19]

DeBoer et al.

[11] Patent Number: 4,552,564

[45] Date of Patent: Nov. 12, 1985

[54] USE OF IMPROVED STARCH-POLYVINYL ALCOHOL COMPOSITION AS A TEXTILE SIZE

[75] Inventors: Edward D. DeBoer, Sauk Village; Kenneth R. Yahl, Orland Park, both of Ill.

[73] Assignee: American Maise-Products Company, Hammond, Ind.

[21] Appl. No.: 635,367

[22] Filed: Jul. 27, 1984

[51] Int. Cl.[4] ..... C08G 18/08

[52] U.S. Cl. ..... 8/115.6; 8/115.7; 252/8.8; 252/8.9; 536/45; 536/50

[58] Field of Search ..... 8/115.6; 252/8.8, 8.9

[56] References Cited

U.S. PATENT DOCUMENTS

| | | | |
|---|---|---|---|
| 2,946,705 | 11/1960 | Olsen | 428/375 |
| 3,070,594 | 12/1962 | Harris et al. | 536/50 |
| 3,664,999 | 5/1972 | Khusid et al. | 536/44 |
| 3,673,171 | 6/1972 | Elizer | 536/50 |
| 3,676,205 | 7/1972 | Elizer | 428/262 |
| 3,676,423 | 7/1972 | Elizer | 536/43 |
| 3,751,411 | 8/1973 | Elizer | 536/49 |
| 3,793,062 | 2/1974 | Elizer et al. | 428/378 |
| 3,793,310 | 2/1974 | Elizer | 536/49 |
| 3,887,752 | 6/1975 | Elizer | 428/378 |

*Primary Examiner*—A. Lionel Clingman
*Attorney, Agent, or Firm*—Lucas & Just

[57] ABSTRACT

An improved size composition of a modified starch and polyvinyl alcohol especially useful as a textile size is disclosed. The modified starch is a hydroxyalkyl and tertiary amino alkyl starch with a D.S. of aminoalkyl groups between 0.02 to 0.30 and a M.S. of hydroxypropyl groups between 0.02 and 0.50. The ratio of polyvinyl alcohol: modified starch in the size composition varies between 1:9 and 9:1. The method of applying the size composition to yarn and the method of making the size composition are also disclosed. High amylose starch, as compared to common or waxy, is the preferred starch.

13 Claims, No Drawings

USE OF IMPROVED STARCH-POLYVINYL ALCOHOL COMPOSITION AS A TEXTILE SIZE

The present invention relates to textile sizes and, in particular, to an improved size composition of polyvinyl alcohol and a modified starch.

Textile sizes are old and well known in the art. They are commonly used on warp yarns to facilitate the weaving process. The size must impart the proper degree of stiffness to the warp yarns and make them more compact, smoother and stronger. In addition, it must be readily removable so that it does not interfere with the subsequent processing of the woven textile, in particular with subsequent dyeing. There are many factors that contribute to a good size, one of these being cost. For greatest cost effectiveness, the size composition should be recoverable.

Polyvinyl alcohol is a commonly used size, especially for hydrophobic fibers such as nylon, polyesters, and the like. Starch and various starch derivatives such as thin boiling starch are also commonly used as size materials. However, the use of starches as the only size is normally limited to hydrophilic fibers. Where starches are used on hydrophobic fibers, they are normally used as a filler or extender in order to reduce cost. Polyvinyl alcohol is a comparatively expensize size and is frequently used in conjunction with less costly materials such as a starch or starch derivative. The degree to which these starches can be used is limited by the effect which they have on the total size composition.

The applicants have now discovered a size composition which utilizes polyvinyl alcohol and a particular modified starch and is comparable to polyvinyl alcohol alone. It has been found that the size composition of the present invention performs at least as well as polyvinyl alcohol alone while costing less than polyvinyl alcohol. It is the combination of the two, the modified starch and the polyvinyl alcohol which leads to the surprising and unexpected results which are disclosed herein. Cost reduction may also be achieved by a reduction in the amount of wax needed in the size composition. In some respects it has been found that the polyvinyl alcohol/-modified starch formulation of the present invention is actually superior as a size as compared to polyvinyl alcohol alone.

Surprisingly, it has been discovered that the size composition of the present invention adheres more readily to polyester than polyvinyl alcohol alone. Conventional starches usually decrease the adhesion of polyvinyl alcohol, however, the increased adhesion to polyester of the size composition of the present invention over polyvinyl alcohol is truly synergistic.

The modified starch is a hydroxy alkyl and tertiary amino alkyl starch derivative. The starch derivative is suitably prepared according to the teaching of U.S. Pat. No. 3,070,594 issued Dec. 25, 1962, which is incorporated by reference herein. The starch derivative as taught by U.S. Pat. No. 3,070,594 is prepared by reacting a starch in the presence of water and alkali with an alkylene oxide and an aminoalkylation agent containing a tertiary amino group at temperatures disclosed therein. A typical structure formula of the starch derivative is:

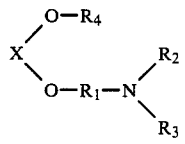

wherein X is a starch, $R_1$ is selected from the group consisting of alkylene and hydroxyalkylene, $R_2$ and $R_3$ are each selected from the group consisting of alkyl, aryl, aralkyl, cycloalkyl and hydrogen and $R_4$ is hydroxyalkyl. $R_4$ may come from the same glucose unit as the

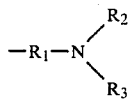

radical in the above formula, or the $R_4$ group may stem from a different glucose unit than the aminoalkyl group.

Alkylene oxides and aminoalkylation agents suitable for preparing the starch derivative are disclosed in U.S. Pat. No. 3,070,594. Preferably propylene oxide is used for the alkylene oxide. When propylene oxide is used as the alkylene oxide, $R_4$ is a hydroxypropyl radical in the structural formula given above.

The preferred aminoalkylation agent is 1-chloro-2-diethylamino ethane, hydrochloride, or diethylaminoethyl chloride, hydrochloride (hereinafter referred to as DEC). When DEC is used as the aminoalkylation agent, the group with the structural formula:

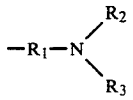

is a diethylaminoethyl group.

The amount of alkylene oxide and aminoalkylation agent used to derive the starch is dependent upon the particular reagent chosen and the desired degree of substitution (hereinafter D.S.) of the aminoalkyl group and the desired molecular substitution ratio (hereinafter M.S.) of the hydroxyalkyl group. D.S. is defined as the average number of hydroxyl groups of anhydroglucose units which have reacted. M.S. is defined as the total number of substituent groups per anhydroglucose unit. The D.S. of the aminoalkyl substituent can range between about 0.02 to about 0.30 with a preferred range between about 0.04 to about 0.12. The M.S. of the hydroxyalkyl substituent can range between about 0.02 to about 0.50 with a preferred range between about 0.08 to about 0.30.

Any starch can be utilized for making the derivation, whether it comes from corn, sorghum, wheat, rice, potato, etc., and whether it is a waxy, common or high amylose variety. The preferred starch has an amylose content of about 20 to about 80% and more preferably about 50 to about 75%.

Any grade of polyvinyl alcohol can be used in the present invention. A low viscosity, fully hydrolyzed grade of polyvinyl alcohol is preferred.

The ratio of polyvinyl alcohol to starch derivative is suitably between 1:9 and 9:1.

The preferred ratio of polyvinyl alcohol to starch derivative will vary depending upon the conditions and economy of use. Different fibers will require different ratios. However, in most cases the range should be between about 1:1 to about 1:4 polyvinyl alcohol: starch derivative. These ratios are by weight of starch derivative and polyvinyl alcohol.

The size composition can suitably be prepared by blending the starch derivative with the polyvinyl alcohol and cooking at the desired solids content level by heating in water, either batchwise or continuously. Alternatively, the starch derivative and polyvinyl alcohol can be cooked separately, then blended together. The preferred temperature at which the modified starch or the size composition is cooked will completely gelatinize the modified starch. This temperature is generally about 60° C. and higher.

The range of total solids content in the size composition will vary depending upon use. In general, it is of advantage to use as high a solids content as possible to decrease evaporation costs with an upper limit being defined by the viscosity of the composition. The viscosity of the composition oomes into play because of equipment constraints and the effects of viscosity on the rate and amount of size penetration into the fiber bundles. Generally speaking and using present technology, i.e. the high pressure squeeze roll slasher, a range between about 10 to about 30% with a preferred range between about 13 to about 20% total solids content by weight can be employed. The size solution of the present invention can include other minor ingredients which are typically used in sizes such as waxes, antiseptics, defoamers, anti-static agents, softeners, etc. However, it is preferred that starch-degrading enzymes not be included since they may tend to interfere with recovery of used size material. It has been found that an anionic binder additive cannot be used in the size composition of the present invention while a cationic or nonionic binder can be.

The starch size can be applied to a textile warp in any known manner. It is preferred that a high pressure squeeze roll slasher be employed since this has been found to give very good results.

After the fabric is woven, it has been found that the size can be readily removed using hot water, preferably above 80° C. The desize liquor can be reconcentrated to the desired solids content level using standard concentrating techniques. This reconcentrated composition of the present invention can then be used again to size further warp yarns.

These and other details and advantages of the present invention may be more fully understood with respect to the following preferred examples chosen for illustration.

EXAMPLE 1

This example illustrates the preparation of three size compositions in accordance with the present invention and one size composition of polyvinyl alcohol (PVOH).

TABLE 1

| | PVOH | Size A | Size B | Size C |
|---|---|---|---|---|
| Starch Derivative (lbs. d.b.) | 0 | 4.20 | 4.20 | 4.20 |
| PVOH (lbs. d.b.) | 8.40 | 4.20 | 4.20 | 4.20 |
| Wax (lbs. d.b.) | 0.588 | 0.588 | 0.588 | 0.588 |

TABLE 1-continued

| | PVOH | Size A | Size B | Size C |
|---|---|---|---|---|
| Water (lbs.) | 64.20 | 64.20 | 64.20 | 64.20 |

The starch derivative in size A is a high amylose starch, about 70% amylose, with a M.S. of hydroxyalkyl substituent of about 0.128 and a D.S. of aminoalkyl substituent of about 0.092. The alkylene oxide was propylene oxide and the aminoalkylation agent was DEC.

The derived starch in size B was a high amylose starch, about 70% amylose, with a M.S. of hydroxyalkyl substituent of about 0.20 and a D.S. of aminoalkyl substituent of about 0.059. The alkylene oxide was propylene oxide and the aminoalkylation agent was DEC.

The two derived starches were prepared in accordance with the teachings of U.S. Pat. No. 3,070,594 set forth above.

Starch C was a conventional starch sold commercially for use as a filler starch to extend PVOH. Starch C was Amaizo 888, an oxidized waxy starch sold by American Maize-Products Company.

The polyvinyl alcohol in all four size compositions was a fully hydrolyzed, low viscosity grade polyvinyl alcohol sold under the trademark Elvanol T66 by duPont.

The wax used was an industrial standard wax used in the yarn size field. The wax was J. P. Stevens Wax No. 15. The only restriction on the wax used for this example and the invention in general is that it not contain anionic polymer. Wax is used in size to soften and lubricate the sized yarn. The procedure for preparing size compositions A, B and C was as follows:

1. In an open kettle steam jacketed cooker, the water, derivative starch and the polyvinyl alcohol were cooked at 205° F. for approximately 30 minutes. The kettle was equipped with an impeller which operated at 1725 rpm during the cooking time. This completely gelatinized the modified starch.

2. The wax was added in the last 5 minutes of the cook time.

3. In this procedure a 14% total solid (t.s.) content size solution was obtained.

EXAMPLE 2

The viscosities of the size compostions of Example 1 were measured in conventional manner and are reported below. It can be seen that the viscosities of sizes A and B are comparable to the rheological properties of PVOH alone.

TABLE 2

| Size | 14% t.s. | | 11% t.s. | | 9% t.s. | |
|---|---|---|---|---|---|---|
| Composition | T °F. | Cps | T °F. | Cps | T °F. | Cps |
| PVOH | 164 | 220 | 178 | 100 | 190 | 50 |
| Size A | 190 | 220 | 98 | 120 | 98 | 55 |
| Size B | 198 | 180 | 186 | 90 | 186 | 40 |
| Size C | 178 | 270 | 184 | 140 | 184 | 70 |

Two dilutions of the above size solutions were made by adding hot tap water to the size solution of 14% total solid content by weight (hereinafter t.s.). To obtain the diluted solutions of size, 6 kg of 14% t.s. size was diluted with 1,636 ml and 1,697 ml of hot tap water to obtain an 11% t.s. and 9% t.s. size solution respectively.

The viscosities were measured with a Brookfield Viscometer, model RVT with spindle No. 2 at 20 rpm following standard procedure.

EXAMPLE 3

In this example the Quality Fiber Lay, QFL, of the size compositions of Example 1 were compared. It can be seen that the sizes of the present invention, A and B, are equivalent to PVOH. This example also illustrates the result that the addition of the starch derivative to the polyvinyl alcohol did not decrease the adhesion of the polyvinyl alcohol to any objectionable extent even though the yarn used for this example was predominately hydrophobic, polyester. Size C, made with an oxidized waxy starch, exhibits properties closer to those of unsized yarn than to yarn sized with PVOH.

TABLE 3

| Yarn | Size Add-on Level % | QFL Value |
|---|---|---|
| Unsized | 0 | 4.07 |
| PVOH | 17.8 | 2.00 |
| Size A | 19.4 | 2.00 |
| Size B | 17.0 | 2.82 |
| Size C | 19.0 | 3.07 |

The QFL value measures the ability of the size to cement down the outer fibers of the yarn. It is used to quantify the yarn attribute of fuzziness or hairiness.

The yarn used for this example was 65% polyester and 35% cotton having a cotton count of 35 singles.

The following procedure was used in this Example 3 to size the yarn and measure the QFL:

1. A Calloway slasher was used to size the yarn. The size solution was maintained at 195° F. The size contained 14% total solids. The sizes used in this example were those prepared in Example 1 above.
2. One hundred and fifty yarn bundles were fed through the slasher, at a rate of 15 ypm, in three inch wide bands.
3. The bands were then fed through a squeeze roll at a pressure of 35 pli.
4. The sized yarn was then dried by passing it over four Teflon coated, eighteen inch diameter drying cylinders, each at 250° F.
5. The dry sized yarn was then rated for QFL using a typical fiber shadowgram and the average of these ratings was computed and appears in Table 3 above. The QFL values are dependent upon the conditions of sizing, the quality of the unsized yarn and the conditions of testing such as add-on level.

Penetration of the size compositions used in these examples was observed by cutting a cross section of the sized yarn with a microtome and then examining the cross section with a microscope. Size must penetrate into the yarn enough to cement down or anchor the outer fibers on the yarn but not so far as to cause the yarn to become rigid or inflexible. The microscopic examination of the yarn also showed that size compositions A and B produce a better emulsion of wax than PVOH alone so that the amount of wax needed in size compositions made in accordance with the present invention may be reduced. A reduction in the amount of wax used in the size composition leads to a further reduction in cost.

EXAMPLE 4

Abrasion resistance is the ability of the sized yarn to withstand abrasion. During the weaving process warp yarn is subject to abrasion as the weft yarn is passed back and forth through the loom. Abrasion resistance is used to predict the weavability of the sized yarn before actual weaving.

TABLE 4

| Size | Dry size Add-on Level % | Abrasion Resistance (cycles to break) |
|---|---|---|
| Unsized | 0 | 71 |
| PVOH | 17.8 | 156 |
| PVOH | 12.5 | 95 |
| PVOH | 9.6 | 80 |
| Size A | 19.4 | 122 |
| Size A | 14.0 | 91 |
| Size A | 9.7 | 81 |
| Size B | 17.0 | 104 |
| Size B | 11.6 | 85 |
| Size B | 8.4 | 78 |
| Size C | 19.0 | 90 |
| Size C | 13.1 | 68 |
| Size C | 9.8 | 67 |

Abrasion resistance was calculated for different add-on levels. The size compositions were those of Example 1 and the yarn was sized in accordance with Example 3. The sized yarn was then subjected to a Zweigle abrader, a standard abrader within the industry, and the number of cycles were recorded when the sized yarn broke. The tension on the sized yarn was 30 gr. per yarn and 800 grit abrasive paper was used.

Abrasion resistance is numerically, directly related to the size add-on level. In order to compare the abrasion resistances of the compositions shown in Table 4, a linear regression analysis was used to compute abrasion resistance for specific add-on levels. This comparison data shows no significant difference between abrasion resistance values for pure PVOH and sizes A and B, at a 10% size add-on level. Size C, made with conventional starch, exhibits a significant difference from pure PVOH.

TABLE 5

| | Abrasion Resistance Cycles to Break | | | |
|---|---|---|---|---|
| Add-on Levels % | PVOH | Size A | Size B | Size C |
| 10.0 | 79 | 79 | 82 | 64 |
| 13.0 | 108 | 92 | 91 | 72 |
| 15.0 | 127 | 101 | 97 | 78 |
| 16.0 | — | — | 100 | — |
| 22.9 | — | — | — | 100 |

In Table 5, add-on levels were calculated for an abrasion resistance of 100 cycles to break. One hundred cycles to break is considered to be a commercially acceptable standard for predicting weavability of sized 65:35 polyester: cotton yarn of the type used in the above test.

EXAMPLE 5

The strength and elongation of the sized yarn was compared in this example. It can be seen that yarn sized with sizes A and B are comparable to yarn sized with PVOH alone for strength and elongation.

TABLE 6

| Yarn | % Solid Add-on | Breaking Strength (lbs.) | Elongation at Break (%) |
|---|---|---|---|
| Unsized | — | 0.60 | 20.6 |
| Size PVOH | 17.8 | 0.65 | 10.6 |
| Size A | 19.4 | 0.62 | 9.4 |
| Size B | 17.0 | 0.65 | 10.9 |

The sized yarn used for this example was sized in accordance with Example 3 above and the size compositions are those of Example 1. Elongation and breaking strength were calculated in accordance with standard procedures within the industry. Elongation for sized yarn is typically lower than elongation for unsized yarn because the sized yarn is stretched during slashing operations and the dried size holds the yarn in this partially elongated state.

EXAMPLE 6

The following example illustrates the improved adhesion between a size film of the present invention and polyester compared to a fully hydrolyzed PVOH size and the same polyester. This is truly synergistic because the conventional starches, when added to a size, usually decrease the adhesion of size to polyester yarn. This example also illustrates that the size composition of the present invention is comparable to the PVOH-only size composition.

TABLE 7

| Starch Used | Film Composition Starch:PVOH | Tensile Strength (psi) Yield | Rupture | % Elongation | Fold Endurance | Adhesion to Mylar (lbs.) |
|---|---|---|---|---|---|---|
| — | 0:1 | 1402 | 3657 | 88.7 | 32,404 | 0.102 |
| 1 | 1:9 | 2667 | 4772 | 111.3 | 23,672 | 0.058 |
| 1 | 1:1 | 4002 | 3291 | 9.8 | 2,907 | 0.162 |
| 1 | 9:1 | 5607 | 4565 | 12.8 | 175 | 0.414 |
| 5 | 1:1 | 4132 | 3693 | 5.3 | 279 | 0.032 |

Starch 1 was a high amylose starch of 70% amylose, with an M.S. of hydroxypropyl groups of about 0.128 and a D.S. of aminoalkyl groups of about 0.092. Starch 1 was prepared in accordance with the teachings of U.S. Pat. No. 3,070,594 as disclosed previously.

Starch 5 was a commercially available cationic common corn starch.

The following procedure was employed in this Example 6 to determine the data in Table 7:

1. Size Composition Preparation: The five separate size compositions in Table 7 were prepared by combining the respective ingredients in their respective proportion, by their respective weight as given in the column headed "Film Composition Starch: PVOH", in a 1 liter stainless steel beaker and agitated to produce a uniform slurry, with 10% total solids content. Steam was then applied to the beaker and the slurry was heated to 95° C. or more for 30 to 45 minutes. A 2-inch diameter, 3 blade propeller-type agitator was used, and the rate of shear was maintained at 1000 rpm throughout the cook. After cooking, solids levels were adjusted to the original level by weight, and the solutions were cooled to the desired temperature for viscosity measurement and film casting.

2. Film was prepared in the following manner: Films were cast by a manual drawdown technique, using a gate-type film applicator. The film solution was applied to a Teflon or Mylar substrate and the applicator was moved in a uniform linear manner to spread the solution in the shape of a 2 inch wide film. The cast films were stored overnight at 73±2° F. and 50+2% relative humidity prior to testing.

3. Solutions were tested in the following manner: The solution viscosities were measured with a Brookfield (Model RVF-100) viscometer. Compatibility of solution components was observed both microscopically, anytime after cooking, and macroscopically, after static aging of the solution at room temperature for 24 hours. The pH of the solution is also measured, either before or after cooking, or both.

4. Film Testing: Tensile Yield, Tensile Rupture and Percent of Elongation were determined with a Thwing-Albert or similar tensile tester, by pulling a 15 mm wide sample film apart longitudinally and recording the force required to do so. Mylar adhesion is defined as a peeling adhesion, i.e. the force required to pull a 1.5 inch wide film of the subject material from the sheet of delustered Mylar on which it was cast. The force of adhesion is measured with the Thwing-Albert tensile tester. Folding endurance is measured with an MIT Folding Endurance Tester, which double-folds a tensioned film strip along a fulcrum parallel to the width of the filmstrip.

The preceding data and conclusions drawn thereon were based on a definition of what a good size would portray as a film. The following definition was chosen:

Tensile Strength (psi):

Yield: Between 2500 and 4000
Rupture: Between 2500 and 4000
Elongation %: 8% (any yarn with cotton in it)
Folding Endurance: Greater than 2400 folds
Adhesion to Mylar: Greater than 0.130 lbs.

From the data in Table 7, it can be seen that the adhesion between Mylar and the size composition of the present invention was better than the conventional starch derivative used with PVOH. The analogy between film data and size performance is well-known to those skilled in the art.

It is readily apparent from the data above that the starch and PVOH composition of the present invention performs as well as PVOH by itself and, in certain regards, is superior thereto. This is in contrast to most starches which are generally not used for their functionality.

It will be understood that the claims are intended to cover all changes and modifications of the preferred embodiments of the invention herein chosen for the purpose of illustration which do not constitute a departure from the spirit and scope of the invention.

What is claimed is:

1. A composition for sizing yarn which comprises a derivative starch having the following structural formula:

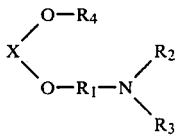

wherein X is starch, $R_1$ is selected from the group consisting of alkylene and hydroxyalkylene, $R_2$ and $R_3$ are each selected from the group consisting of alkyl, aryl, aralkyl, cycloalkyl and hydrogen and $R_4$ is a hydroxyalkyl; and polyvinyl alcohol, wherein the composition has a ratio of derivative starch: polyvinyl alcohol in the range of from about 1:9 to 9:1.

2. The composition of claim 1 wherein X is a starch with an amylose content of about 20 to about 80%.

3. The composition of claim 1 wherein the derivative starch has a D.S. of aminoalkyl groups between about 0.02 to about 0.30 and a M.S. of hydroxyalkyl groups between about 0.02 to about 0.50.

4. The composition of claim 1 wherein $R_4$ is hydroxypropyl and the group with the structural formula of:

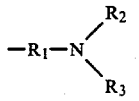

is a diethylaminoethyl group.

5. A composition for sizing yarn which comprises a modified starch having the following structural formula:

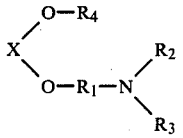

wherein X is a starch with an amylose content between about 50 to about 70%, $R_4$ is hydroxypropyl and the group with the structural formula:

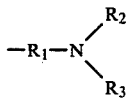

is a diethylaminoethyl group, and the modified starch has a D.S. of diethylaminoethyl groups between about 0.04 to about 0.12 and a M.S. of hydroxypropyl groups between about 0.08 to about 0.30; and polyvinyl alcohol, wherein the ratio of polyvinyl alcohol:modified starch is in the ratio between about 1:9 to about 9:1.

6. A method for sizing a yarn which comprises applying to the yarn a size composition comprising a modified starch having the following structural formula:

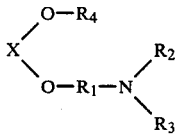

wherein X is starch, $R_1$ is selected from the group consisting of alkylene and hydroxyalkylene, $R_2$ and $R_3$ are each selected from the group consisting of alkyl, aryl, aralkyl, cycloalkyl and hydrogen and $R_4$ is a hydroxyalkyl; and polyvinyl alcohol, wherein the size composition has a ratio of modified starch: polyvinyl alcohol of between about 1:9 to about 9:1.

7. The method of claim 6 wherein X is a starch with an amylose content of about 20 to about 80%.

8. The method of claim 6 wherein the modified starch has a D.S. of aminoalkyl groups between about 0.02 to about 0.30 and a M.S. of hydroxyalkyl groups of between about 0.02 to about 0.50.

9. The method of claim 6 wherein $R_4$ is hydroxypropyl and the group with the structural formula of:

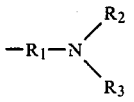

is a diethylaminoethyl group.

10. A method of making a size composition comprising:

(a) blending a modified starch having the following formula:

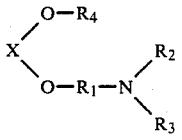

wherein X is starch, $R_1$ is selected from the group consisting of alkylene and hydroxyalkylene, $R_2$ and $R_3$ are each selected from the group consisting of alkyl, aryl, aralkyl, cycloalkyl and hydrogen and $R_4$ is a hydroxyalkyl; and polyvinyl alcohol, wherein the composition has a ratio of modified starch: polyvinyl alcohol in the range of from about 1:9 to 9:1; and (b) cooking said blend to a total solids content between about 10 to about 30%.

11. The method of claim 10 wherein X is a starch with an amylose content of about 20 to about 80%.

12. The method of claim 10 wherein the modified starch has a D.S. of aminoalkyl groups between about 0.02 to about 0.30 and a M.S. of hydroxyalkyl groups of between about 0.02 to about 0.50.

13. The method of claim 10 wherein $R_4$ is hydroxypropyl and the group with the structural formula of:

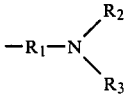

is a diethylaminoethyl group.

* * * * *